US005239757A

United States Patent [19]

Weaber

[11] Patent Number: 5,239,757

[45] Date of Patent: Aug. 31, 1993

[54] PORTABLE CAN OPENER APPARATUS

[76] Inventor: Tim E. Weaber, R.D. #2, Box 742-1, Annville, Pa. 17003

[21] Appl. No.: 962,694

[22] Filed: Oct. 19, 1992

[51] Int. Cl.[5] ..... B67B 7/400; B67B 7/414

[52] U.S. Cl. ..... 30/401; 30/404

[58] Field of Search ..... 30/401, 402, 403, 404, 30/405, 413, 418, 421, 424

[56] References Cited

U.S. PATENT DOCUMENTS

| | | | |
|---|---|---|---|
| 3,060,568 | 10/1962 | Nisenson | 30/405 |
| 3,254,406 | 6/1966 | Hubrich | 30/401 |
| 3,689,999 | 9/1972 | Swanke et al. | 30/401 |
| 3,768,159 | 10/1973 | Emmons et al. | 30/404 |
| 3,858,313 | 1/1975 | Yamaguchi | 30/404 |
| 4,734,985 | 4/1988 | Ozaki | 30/404 |

*Primary Examiner*—Douglas D. Watts
*Assistant Examiner*—Paul M. Heyrana, Sr.
*Attorney, Agent, or Firm*—Leon Gilden

[57] ABSTRACT

A can opener structure, battery operative, is arranged to include a high torque output motor in operative communication with the battery and an associated on/off switch mounted through a top wall of the housing of the organization. The battery and drive motor are mounted within the housing in adjacency to the floor of the housing to orient a lower center of gravity within the housing for stability of the organization, and wherein further, an optional push bar arrangement is arranged for effective operation of the normally opened on/off switch utilized by the housing structure to permit ease of one-handed use of the device.

1 Claim, 4 Drawing Sheets

PORTABLE CAN OPENER APPARATUS

BACKGROUND OF THE INVENTION

1. Field of the Invention

The field of invention relates to can opener apparatus, and more particularly pertains to a new and improved portable can opener apparatus wherein the same utilizes rechargeable battery structure for operation of the output wheel of the apparatus.

2. Description of the Prior Art

While portable can opener structure has been utilized in the prior art, such apparatus has typically required elongate housing structure such as indicated in the U.S. Pat. Nos. 4,734,985 and 4,702,007, wherein cans must be accordingly positioned upon a support surface, with the apparatus mounted to the can structure.

The instant invention attempts to overcome deficiencies of the prior art by providing for a raised height housing structure permitting positioning of a multitude of cans relative to the housing. Further, the housing positions the drive motor and recharges the battery structure in adjacency to a lowermost portion of the housing to orient a center of gravity of the housing in a lowered orientation with the housing for stability in use.

Other prior art can opener structure is exemplified in the U.S. Pat. Nos. 4,922,617; 4,622,749; and 4,782,594. The prior art has failed to set forth a housing structure whose height is substantially greater than its width to permit accommodation of variously sized cans of increased height during an opening procedure and in this respect, the present invention substantially fulfills this need.

SUMMARY OF THE INVENTION

In view of the foregoing disadvantages inherent in the known types of can opener apparatus now present in the prior art, the present invention provides a portable can opener apparatus wherein the same employs a battery operative drive motor within a can opener housing positioned within a lowered orientation within the housing for a lowered center of gravity relative to the apparatus. As such, the general purpose of the present invention, which will be described subsequently in greater detail, is to provide a new and improved portable can opener apparatus which has all the advantages of the prior art can opener apparatus and none of the disadvantages.

To attain this, the present invention provides a can opener structure, battery operative, arranged to include a high torque output motor in operative communication with the battery and an associated on/off switch mounted through a top wall of the housing of the organization. The battery and drive motor are mounted within the housing in adjacency to the floor of the housing to orient a lower center of gravity within the housing for stability of the organization, and wherein further, an optional push bar arrangement is arranged for effective operation of the normally opened on/off switch utilized by the housing structure to permit ease of one-handed use of the device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable can opener apparatus which has all the advantages of the prior art can opener apparatus and none of the disadvantages.

It is another object of the present invention to provide a new and improved portable can opener apparatus which may be easily and efficiently manufactured and marketed.

It is a further object of the present invention to provide a new and improved portable can opener apparatus which is of a durable and reliable construction.

An even further object of the present invention is to provide a new and improved portable can opener apparatus which is susceptible of a low cost of manufacture with regard to both materials and labor, and which accordingly is then susceptible of low prices of sale to the consuming public, thereby making such portable can opener apparatus economically available to the buying public.

Still yet another object of the present invention is to provide a new and improved portable can opener apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
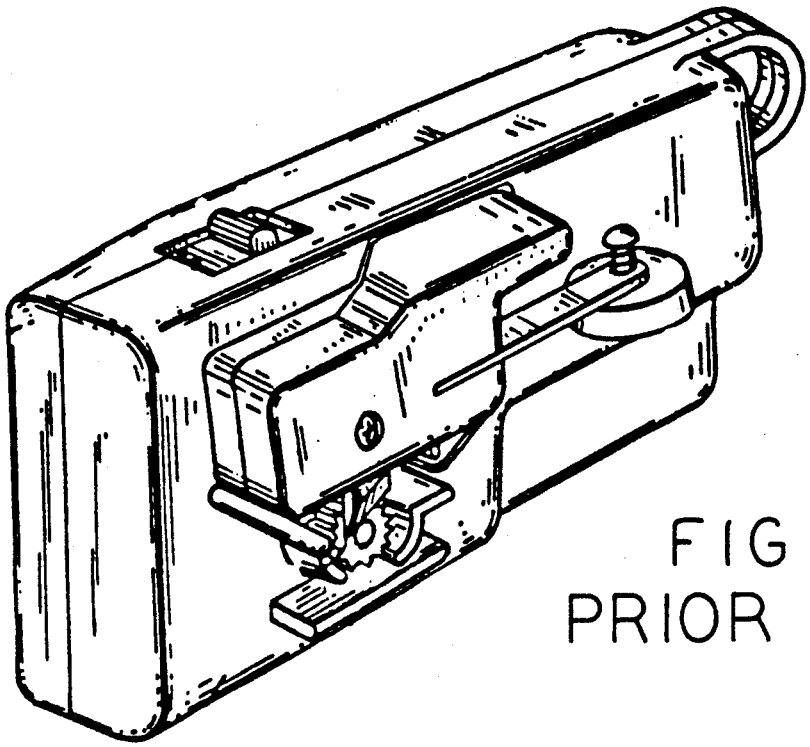
FIG 1 PRIOR ART
FIG. 1 is an isometric illustration of a prior art can opener apparatus, as exemplified in the U.S. Pat. No. 4,734,985.
Figure 2:
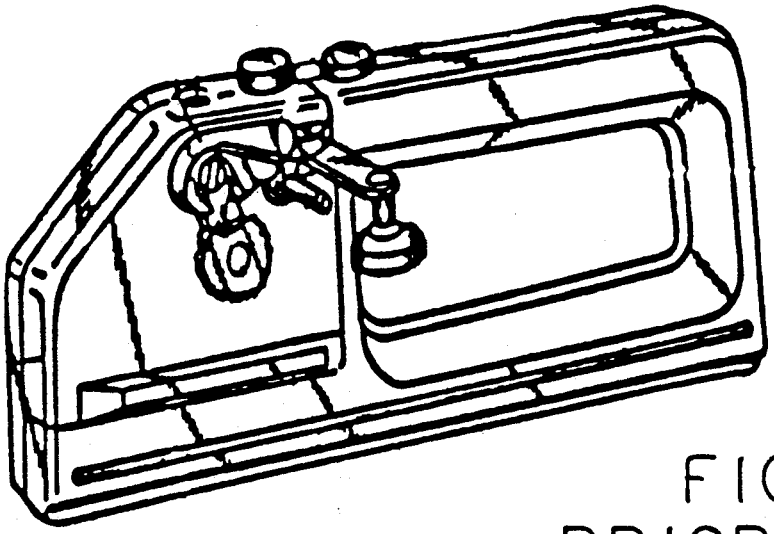
FIG 2 PRIOR ART
FIG. 2 is an isometric illustration of a prior art can opener structure, as exemplified in the U.S. Pat. No. 4,701,007.
Figure 3:
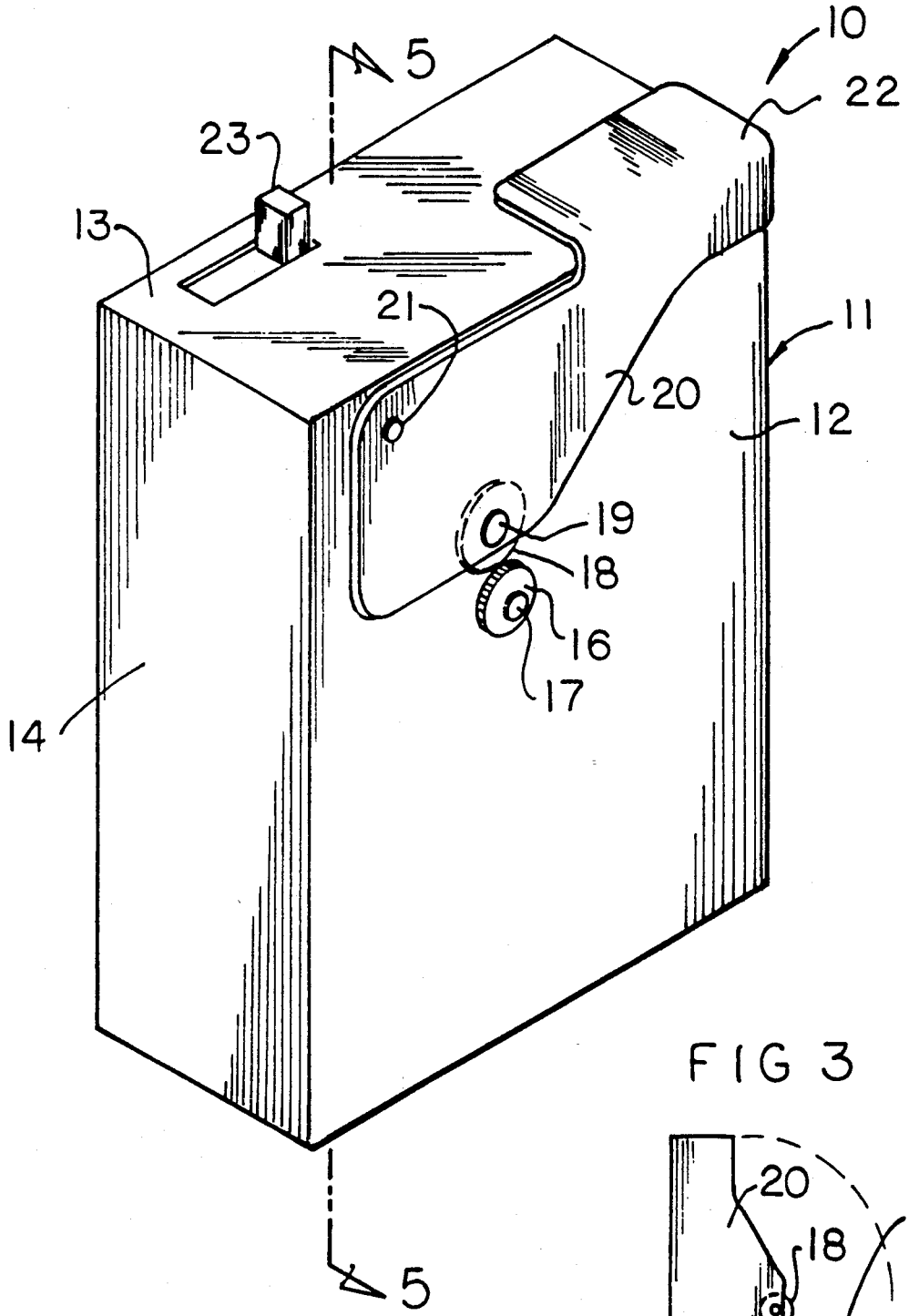
FIG. 3 is an isometric illustration of the instant invention.
Figure 4:
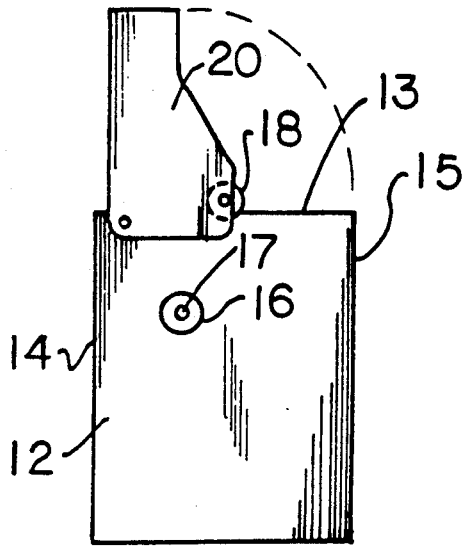
FIG. 4 is an orthographic frontal view of the invention taken in elevation.
Figure 5:
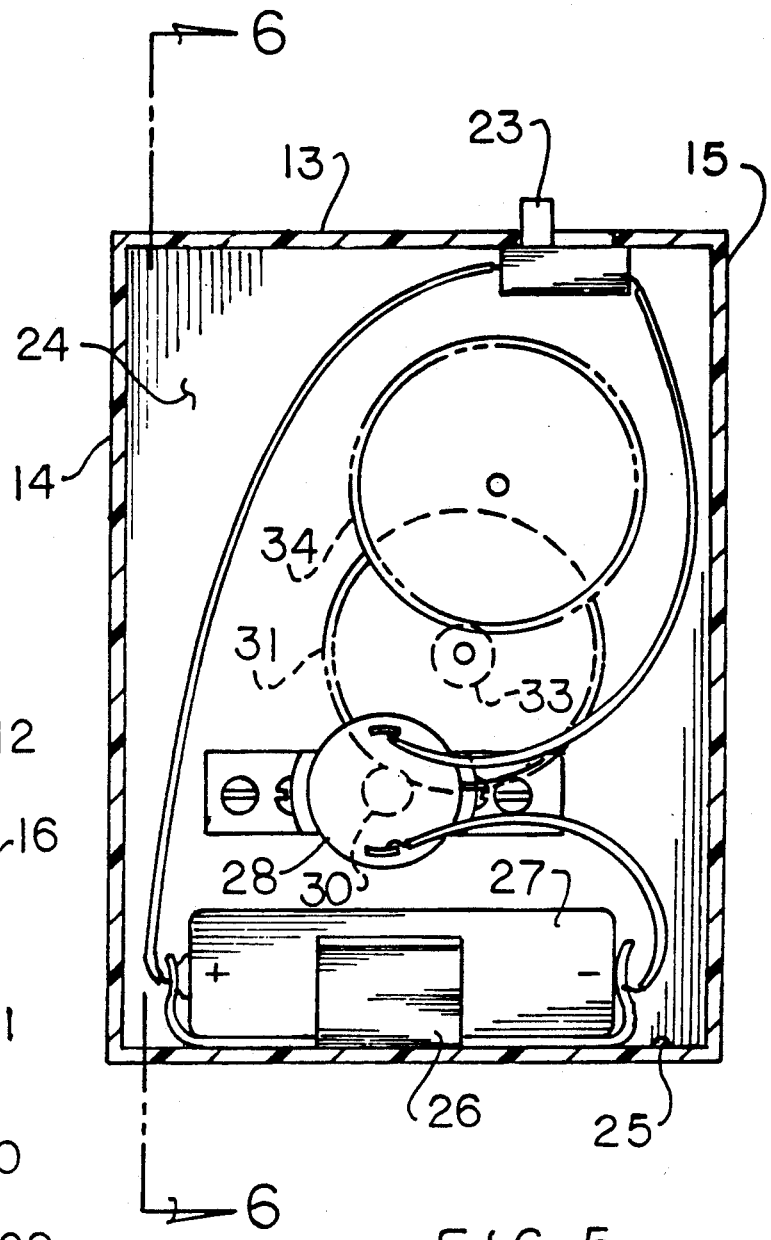
FIG. 5 is an orthographic view, taken along the lines 5—5 of FIG. 3 in the direction indicated by the arrows.
Figure 6:
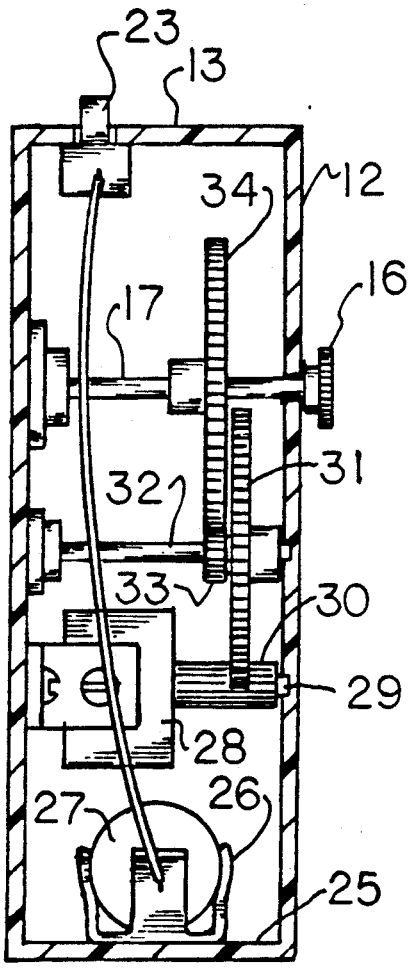
FIG. 6 is an orthographic view, taken along the lines 6—6 of FIG. 5 in the direction indicated by the arrows.

With reference now to the drawings, and in particular to FIGS. 1 to 8 thereof, a new and improved portable can opening apparatus embodying the principles and concepts of the present invention and generally designated by the reference numeral 10 will be described.

More specifically, the portable can opener apparatus 10 of the instant invention essentially comprises a housing 11 including a front wall 12, a top wall 13, and spaced respective first and second side walls 14 and 15. A can driving wheel 16 is fixedly mounted to a can driving wheel shaft 17 that is orthogonally and rotatably directed through the front wall 12, with the can driving wheel 16 oriented parallel to and in spaced relationship relative the front wall 12. A cutter wheel 18 is arranged in cooperative relationship relative to the can driving wheel 16 to secure a can between the can driving wheel 16 and the cutter wheel 18 and is mounted to a cutter wheel axle 19 that in turn is rotatably mounted to a cutter wheel support flange 20. The support flange 20 is mounted pivotally about a pivot axle 21 secured to the front wall 12 in adjacency to the top wall 13 and the first side wall 14. A support flange abutment plate 22 orthogonally mounted to the support flange 20 in a spaced relationship relative to the pivot axle 21 is arranged for abutment with the top wall 13 to limit pivotal orientation of the cutting wheel 18 relative to the can driving wheel 16. A normally open switch 23 is mounted to the top wall for manual manipulation of the switch to effect actuation of the can driving wheel 16 and directed an associated can relative to the cutter wheel 18.

The housing 11 is formed with a housing cavity 24 having a cavity floor 25. A U-shaped spring clip 26 is mounted to the cavity floor for securement of a rechargeable battery 27. The rechargeable battery may be arranged for recharging in a manner as indicated in the prior art, and more specifically by U.S. Pat. No. 4,702,007 incorporated herein by reference.

A drive motor 28 is positioned in adjacency to the battery 27 below a medial portion of the housing cavity 24. It should be noted that the front wall at its predetermined height is substantially greater than a predetermined width of the front wall and top wall to accommodate cans of greater axial length relative to the cutter structure. A drive motor output shaft 29 is rotatably mounted within the housing cavity 24, and includes a first gear 30 of a first diameter. A second gear 31 of a second diameter is mounted to a second gear shaft 32 that is parallel to the output shaft 29. The second gear is of a second diameter greater than the first diameter, and includes a third gear 33 on the second gear shaft in adjacency to the second gear 31. A third gear 33 is of a diameter equal to the first diameter to permit the lowered orientation of the drive motor within the housing cavity and permitting operative communication of the third gear 33 with a fourth gear 34 of a diameter equal to the second diameter and thereby position the increased torque output of the drive motor 28 in a spaced orientation thereto, with the fourth gear 34 mounted about the can driving wheel shaft 17 that in turn is parallel to the second gear shaft 32 and the output shaft 29. The can driving shaft 17 is accordingly positioned above a medial position relative to the front wall 12 and the housing cavity 24.

Figure 7:
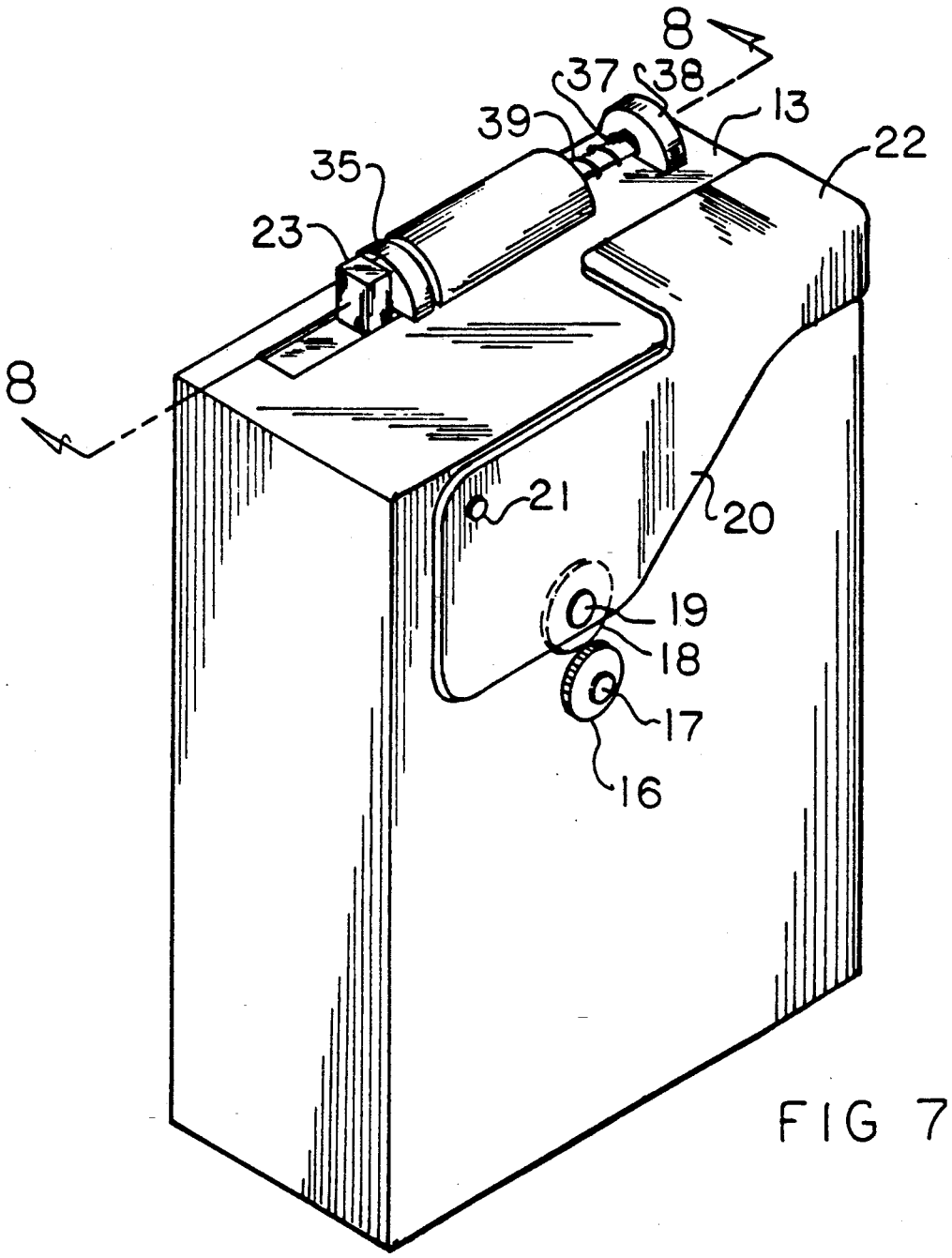
FIG. 7 is an isometric illustration of the apparatus employing a push bar structure relative to the on/off switch of the housing.
Figure 8:
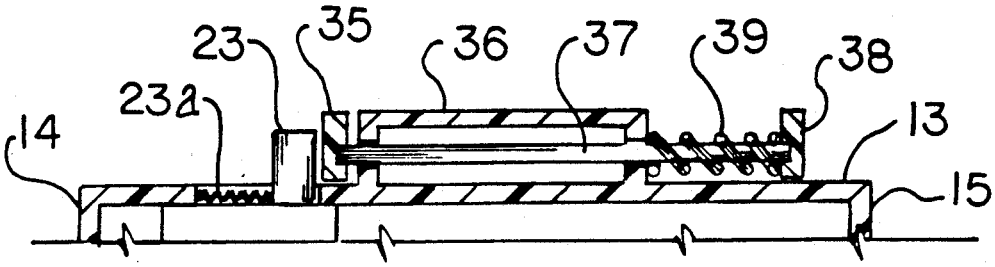
FIG. 8 is an orthographic view, taken along the lines 8—8 of FIG. 7 in the direction indicated by the arrows.

The FIGS. 7 and 8 indicate the use of a push bar structure to provide for ease of one-handed utilization of the organization. The normally opened switch 23 includes a switch spring 23*a* to bias the switch in the opened orientation in adjacency to the push bar 35. The push bar 35 is orthogonally oriented relative to the top wall 13 and includes a push bar rod 37 orthogonally and medially oriented relative to the push bar 35. The push bar rod 37 is slidably directed through a push bar housing 36 fixedly mounted to the top wall 13, with the push bar 35 mounted to a first end of the push bar rod 37 and a second remote end of the push bar 37 having a flange plate 38 that is normally positioned in adjacency to the second side wall 15. A spring member 39 is interposed between the flange plate 38 and the push bar housing 36 to normally bias the push bar 35 in a first position in adjacency to the push bar housing 36 permitting its displacement into a second position spaced from the push bar housing 36 to effect closure of the switch 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable can opener apparatus, comprising, a housing, the housing having a front wall, a top wall, and a first side wall spaced from a second side wall, and the front wall defined by a predetermined height, and the front wall having a predetermined width subtantially less than the predetermined height, and a can driving wheel having a can driving wheel shaft, with the can driving wheel shaft orthogonally directed into the front wall, and the housing having a housing cavity, and drive means mounted within the housing cavity to effect selective rotation of the can driving wheel, and a support flange, the support flange having support flange pivot axle, the support flange pivot axle fixedly and orthogonally mounted to the housing front wall in adjacency to the top wall and the first side wall, and the support flange having a support flange top edge, and the top edge having an abutment plate orthogonally and fixedly mounted to the support flange, and the abutment plate arranged for abutment with the top wall for limiting pivotal rotation of the support flange relative to the top wall, and a cutter wheel, the cutter wheel having a cutter wheel axle, the cutter wheel axle fixedly and orthogonally mounted to the support flange for positioning the cutter wheel in operative adjacency to the can driving wheel upon abutment of the abutment plate relative to the top wall, and a normally opened switch mounted through the top wall, the normally opened switch in operative communication with the drive means to effect selective actuation of the drive means, and wherein the housing cavity has a housing cavity floor, and the housing cavity floor includes a battery member mounted to the housing floor, with the drive means including a drive motor, the drive motor and the battery positioned within the housing cavity, and the housing cavity having a mid point medially of the housing cavity along said predetermined height, and the drive motor and the battery positioned below the mid point, and the drive means further including an output shaft mounted to the drive motor, the output shaft having a first gear of a first diameter, and a second gear of a second diameter greater than the first diameter, and the second gear having a second gear shaft parallel to the output shaft, and a third gear fixedly mounted to the second shaft in adjacency to the second gear, the third gear having a third gear diameter substantially equal to the first diameter, and a fourth gear, the fourth gear mounted fixedly to the can driving wheel shaft, and the fourth gear having a fourth gear diameter equal to the second diameter, and the switch includes a switch spring to bias the switch in a normally electrical open orientation, and a push bar, the push bar positioned in adjacency to the switch, and the push bar having a push bar rod fixedly and orthogonally mounted to the push bar, and a push bar housing, the push bar housing slidably receiving the push bar rod therethrough, the push bar rod arranged parallel to the top wall, and the push bar rod having a first end, with the push bar fixedly mounted to the first end, the push bar rod having a second end, and the second end including a flange plate fixedly mounted to the second end, and a push bar spring mounted between the housing and the flange plate to bias the push bar in adjacency to the push bar housing intermediate the push bar housing and the switch, with the flange plate positioned in adjacency to the second side wall and the abutment plate.

* * * * *